United States Patent [19]

Foster, Jr.

[11] Patent Number: 4,741,143

[45] Date of Patent: May 3, 1988

[54] PIER SLED WITH INTEGRAL TIE WIRES

[76] Inventor: Thomas W. Foster, Jr., 3901 Shady Valley Dr., Arlington, Tex. 76013

[21] Appl. No.: 915,772

[22] Filed: Oct. 6, 1986

[51] Int. Cl.[4] ..... E04C 5/16

[52] U.S. Cl. ..... 52/677; 405/239

[58] Field of Search ..... 52/677–687, 52/646, 742; 405/239

[56] References Cited

U.S. PATENT DOCUMENTS

| | | | |
|---|---|---|---|
| 790,230 | 5/1905 | Stemple | 405/216 |
| 1,356,315 | 10/1920 | Scofield et al. | 52/685 |
| 1,708,277 | 4/1929 | Martin | 52/652 |
| 1,946,418 | 2/1934 | Welch | 52/684 |
| 2,612,024 | 9/1952 | Hunsucker | 52/646 |
| 3,257,767 | 6/1966 | Lassy | 52/652 |
| 3,471,986 | 10/1969 | Swenson | 52/652 |
| 3,722,164 | 3/1973 | Schmidgall | 52/684 |
| 4,627,211 | 12/1986 | Foster | 405/239 |

FOREIGN PATENT DOCUMENTS

| | | | |
|---|---|---|---|
| 876459 | 5/1953 | Fed. Rep. of Germany | 52/677 |
| 2289696 | 5/1976 | France | 52/686 |

*Primary Examiner*—James L. Ridgill, Jr.
*Attorney, Agent, or Firm*—Charles W. McHugh

[57] ABSTRACT

A combination sled/spacer comprising a molded body which has tie wires permanently connected thereto. The sled/spacer is adapted to be affixed to the outer surface of a steel reinforcing cage prior to the time that the cage is inserted into a pier hole in the ground. A preferred material for the molded body is a cementitious material, so that the concrete which is poured around the reinforcing cage will be similar to the material from which the sled/spacer is made. A plurality of longitudinal and transverse tie wires is preferred, so that the sled/spacer may be connected easily to both longitudinal and spiral members of a reinforcing cage. A typical sled/spacer has a length within the range of six to twelve inches, and is tapered from a wide surface which lies immediately adjacent the reinforcing cage, to a more narrow surface which bears against the sides of a pier hole. The surface which is expected to rub against the side of a pier hole is preferably convex.

11 Claims, 2 Drawing Sheets

PIER SLED WITH INTEGRAL TIE WIRES

BACKGROUND OF THE INVENTION

This invention relates generally to the art of fabricating concrete piers in the earth; more particularly, the invention relates to a support which is adapted to be affixed to a steel reinforcing cage for the purpose of fostering the lowering of the cage into a pier hole—just prior to the time that concrete is poured into the hole.

This particular invention is related to another invention which is disclosed in co-pending U.S. application Ser. No. 778,975 entitled "Sled For A Reinforcing Cage Used In A Pier," now U.S. Pat. No. 4,627,211 issued Dec. 9, 1986.

As described in the aforementioned patent, it is well known to reinforce concrete piers and other concrete structures with steel reinforcing rods that are tied together to form what is called a cage. And it is also known to provide spacers in order to hold such reinforcing rods (or equivalent steel mesh) away from the sides of concrete forms. Examples of such spacers of the prior art are shown in the following: U.S. Pat. No. 790,230 to Stemple entitled "Method of Protecting Piles Or The Like"; No. 1,708,277 to Martin entitled "Device For Positioning The Reenforcement Of Concrete Structures"; No. 3,722,164 to Schmidgall entitled "Spring Wire Spacer, Especially For Spacing Reenforcing Mesh From the Form In The Manufacture Of Concrete Structures And The Like"; No. 3,257,767 to Lassy entitled "Snap-On Spacer Positioner For Reinforcement"; and No. 3,471,986 to Swenson entitled "Spacer For Reinforcing Mesh For Concrete Pipe And The Like."

The invention disclosed in my earlier patent provided definite advantages over the bent wire or bent sheet-metal spacers of the prior art; and the plastic runner provided a definite advantage in that there was no threat to the integrity of a steel reinforcing cage which could be created by the oxidation (rusting) of a spacer. However, there are still some persons who are so cautious and so conservative as to be apprehensive about the durability of even polypropylene in a long-term situation. For those persons who expect a pier to endure and carry loads for a period of 100 years or more, any construction material which has characteristics different from concrete is perhaps suspect. To satisfy those persons who would like the exterior surface of a pier to be 100% concrete, a construction is disclosed herein which can function as an effective spacer or sled, and which can be molded out of concrete. If the spacers or sleds are molded from concrete and then attached to a reinforcing cage before wet concrete is poured around the cage and into the pier hole, then the resulting exterior surface of the pier will be 100% cementitious. With the primary material of the pier and the spacers of this invention having essentially the same coefficient of thermal expansion, etc., there is no opportunity for any environmental condition to later contribute to any structural defect. It is therefore an object of this invention to teach a construction for a pier sled that can be molded from a cementitious material.

It is another object of this invention to provide a pier spacer having integrally molded tie wires which are so firmly embedded in the spacer as to absolutely preclude any accidental tear-out during installation of the spacers of use thereof.

Another object of this invention is to provide an extremely strong but lightweight spacer which can function like a sled in fostering the descent of a reinforcing cage into a pier hole—without doing untoward damage to the sides of the pier hole.

Still another object of the invention is to provide a spacer having integral tie wires which are positioned at the most advantageous locations for achieving a secure installation alongside a reinforcing cage, such that a tie wire does not become accidentally misplaced or omitted.

These and other objects will be apparent from a careful study of the specification provided herewith and the attached drawing to which it refers.

BRIEF SUMMARY OF THE INVENTION

In brief, a device in accordance with this invention comprises a dynamic sled and static spacer which is adapted to be positioned immediately next to the outer surface of at least one member of a metal reinforcing cage. The sled/spacer has a shaped body with first and second spaced surfaces, and the extent of separation of those two surfaces establishes a stand-off distance to hold the reinforcing cage away from the sides of a pier hole. A plurailty of tie wires are integrally molded with the shaped body so as to be permanently connected therewith. There are preferably longitudinal and transverse tie wires, so that the shaped body may be manually affixed to both the longitudinal and the spiral members of a reinforcing cage.

DETAILED DESCRIPTION OF THE PREFERRED EMBODIMENT

Figure 1:
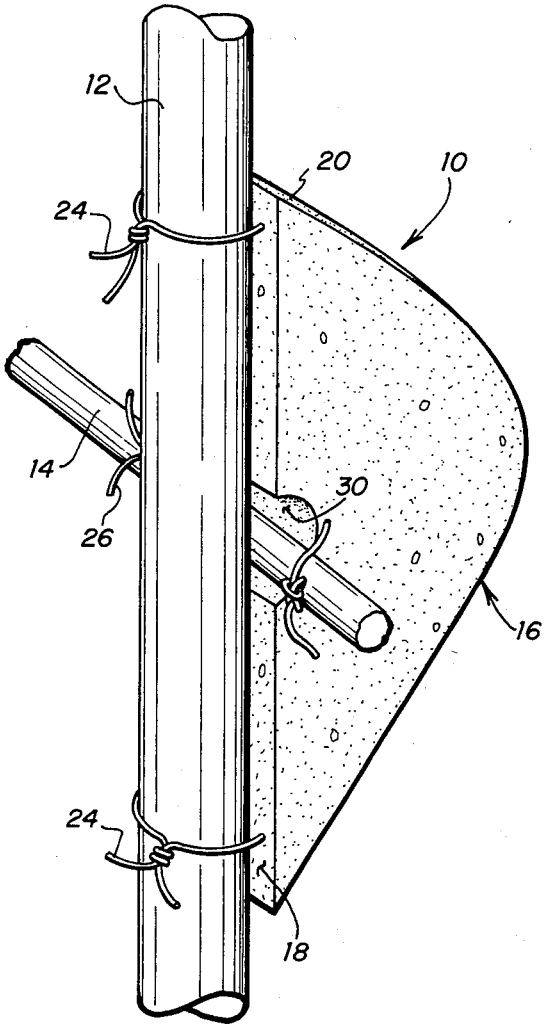
FIG. 1 is a perspective view of a spacer made in accordance with this invention and shown in its installed position alongside a metal reinforcing cage for a concrete pier.
Figure 7:
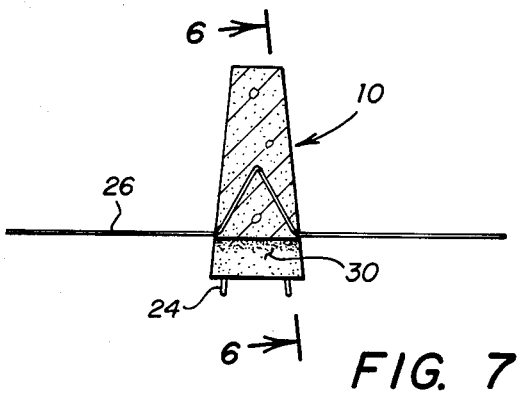
FIG. 7 is an end view of a spacer, cross-sectioned to show the preferred manner of embedding a transverse tie wire in a molded body.
Figure 6:
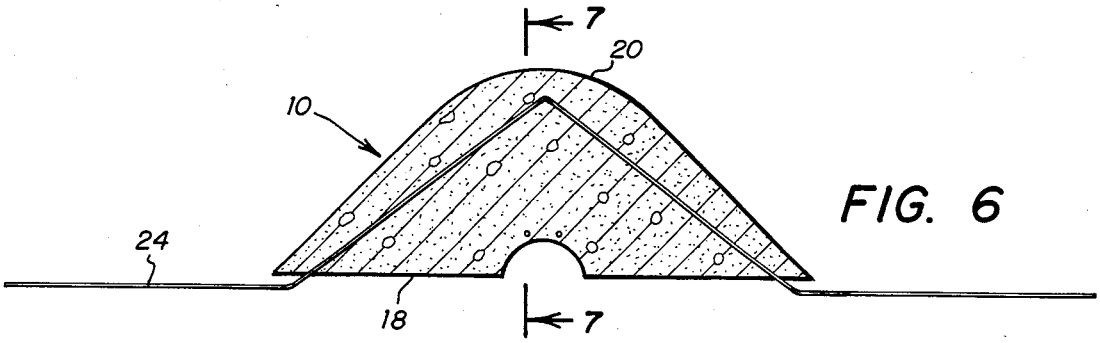
FIG. 6 is a side elevational view, cross-sectioned to illustrate the preferred manner of embedding tie wires in the molded body, and particularly illustrating a longitudinal tie wire.

Referring initially to FIG. 1, a spacer 10 in accordance with this invention is shown in its installed position alongside a metal reinforcing cage. The spacer is located outwardly of the longitudinal members of the cage, represented by the single member 12, as well as the spiral members represented by the helical member 14. The spacer 10 is typically attached to a reinforcing cage prior to the time that the cage is scheduled to be lowered into a prepared pier hole, and just prior to the time that wet concrete is to be poured into the hole and around the cage.

The spacer 10 comprises a shaped body 16 having a first surface 18 which is adapted to be positioned immediately next to an outer surface of a selected longitudinal member 12. The body has a second surface 20 which projects outwardly where it may bear against the sides of the hole in order to foster sliding contact with the sides of the hole. The distance between the first and second surfaces 18,20 may be thought of as a stand-off distance, as far as the reinforcing cage is concerned. That is, the reinforcing cage will be inherently kept away from the sides of the hole by the distance established by the maximum separation of surfaces 18 and 20. This stand-off distance is preferably 3 inches, so that there will be a layer of cured concrete around the reinforcing cage which is at least 3 inches thick. Also, a pier hole may have been drilled slightly oversized, such that a reinforcing cage could be shifted sideways within the hole by an inch or more; but as long as a plurality of spacers 10 are affixed to the periphery of the reinforcing cage, a concrete "jacket" will surround the reinforcing cage with sufficient protection as to guard against any deleterious corrosion, etc.

Because the spacer 10 is oriented with respect to the longitudinal reinforcing cage so as to foster sliding movement thereof, it is reasonable to refer to the spacer as a kind of sled. And since the sled is utilized in fabricating piers, it is reasonable to use the expression "pier sled" when referring to the spacer. However, it should be understood that a minor variation in the configuration of the shaped body 16 should not be deemed to create a device which necessarily falls outside the scope of this invention. And a deviation from a purely convex shape for the second surface 20 might, in some circumstances, be acceptable. Therefore, the invention should be understood to be limited only by the claims which are attached hereto.

Referring still to FIG. 1, a plurality of tie wires 24,26 are formed integrally with the shaped body 16 so as to be permanently connected therewith. The plurality of wires includes longitudinal wires 24 and transverse wires 26, with the longitudinal wires being intended to connect the body to a longitudinal cage member 12, and the transverse wires 26 being adapted to connect the body to a helical cage member 14. Each of the wires has a portion which is securely anchored to the interior of the shaped body, and each wire has exterior portions which extend outwardly from the body for a sufficient distance to facilitate tying the body to the reinforcing cage.

With regard to the material from which the shaped body 16 is made, any strong and non-corrosive material may be serviceable; and the most logical one that will likely occur to those skilled in the art is a thermosetting plastic. However, the preferred material is a cemetitious one, so that the spacer 10 and the concrete which is poured therearound will constitute common materials. A particularly efficacious material is Set-45 magnesium phosphate concrete, which is a product sold by Master Builders of Cleveland, Ohio. This fast-setting concrete compound is used in repairing chuck holes in highways; it is also used to install airport runway lights and to patch pavement, floors, loading docks, etc. One reason for preferring a material like Set-45 compound as a fabricating material is its substantial compressive strength which can be achieved after a relatively short cure time. When properly mixed, the Set-45 material will provide a compressive strength of 6000 psi after only a single day of cure time; this compares very favorably with the typical compressive strength of plain concrete (at 72 F) of only 500 psi. Also, an optimum shaped body in accordance with this invention will weigh about 1½ pounds when formed with the Set-45 material, which is less than a target weight of 2 pounds for such spacers. It should be appreciated, therefore, why a cementitious material like Set-45 constitutes the preferred raw material for the shaped body.

Turning attention next to some of the parameters of the shaped body 16, the first surface 18 preferably is generally flat and has a length of at least 6 inches; such a length is desired in order to provide ample area for making contact with a typical longitudinal rod in a steel reinforcing cage. Such longitudinal stability of a body 16 is important so that it will resist any tendency to roll or shift with respect to a reinforcing cage as that cage is lowered into a pier hole. A maximum length for the first surface 18 is probably about 11½ inches, so that the top half of a given spacer 10 which extends upwardly from one spiral element 14 would not interfere with the lower half of a second spacer which extends downwardly from the next-higher spiral element of a cage. So, even if two spiral elements of a reinforcing cage are positioned as close as one foot apart, there will be no risk of any spatial interference between two adjacent spacers. And to contribute to the lateral stability of the spacer 10, it is preferred that the first surface 18 have a width of at least one inch; its maximum width should probably be only about 2¼ inches, so that its tie wires will be close enough to foster significant stability of the spacer with regard to its associated reinforcing cage.

In order to facilitate the manufacture of spacers in accordance with this invention, the shaped body 16 has a transverse cross section which is tapered, and the taper may be described as having an included angle of about twelve degrees. Such a taper ensures that a cementitious body can easily be removed from a mold after the body has been cast and allowed to cure for about an hour. However, the taper of the shaped body 16 should not be so great as to cause the second surface 20 to take on the appearance of a knife edge. While a relatively narrow second surface 20 might function adequately as a spacer in holding a static cage away from the side of a pier hole, it must be remembered that the construction disclosed herein is expected to function in a dynamic way in supporting a cage as it is lowered into a pier hole. Of course, a truly talented crane operator can often lower a reinforcing cage into a hole in such a way that it remains centered with respect to the hole at all times; and as long as the expected clearance is indeed present, there can be minimal if any rubbing contact between the cage and the pier hole. However, to the extent that real life situations deviate from perfection, there can be a shifting of a reinforcing cage toward one side of the hole. And, it is desired that the spacer 10 serve as a dynamic sled in order to prevent elements of the reinforcing cage from scraping against the sides of the pier hole.

Lest anyone image that too much emphasis is perhaps being given to the dynamic considerations of putting a reinforcing cage into a pier hole, it must be remembered that most reinforcing cages include several helical (of spiral) structural members at the periphery of the cage. It the cage is lowered in direct contact with the sides of the hole, then a steel member which has even the slightest transverse orientation will be scraping along the sides of the hole. This scraping will almost inevitably contribute to knocking dirt and/or rocks off the sides of the hole, such that the depth of the hole is shortened by the quantity of loose material which falls to the bottom and accumulates there. Also, loose dirt in a hole will tend to mix with wet concrete that is poured into the hole, thereby weakening the resultant pier. By designing a spacer 10 which is adapted to be affixed to a cage so that its rubbing surface 20 is convex and parallel to the direction of movement of the cage, easy and safe installation of a reinforcing cage is fostered.

To facilitiate the step of locating and tying a spacer 10 to a reinforcing cage, a concave portion 30 is built into the first surface 18 near the center thereof. The radius for this concave portion 30 is preferably substantially smaller than the radius of the convex second surface 20; an exemplary radius of the concave portion 30 is ½ inch. In establishing the center of the arc which defines the concave portion 30, it is preferable that the center be in the plane of the first surface 18 or slightly toward the second surface 20, this will ensure that there is ample clearance space for a spirally wrapped member of a reinforcing cage.

Turning attention now to the integrally molded tie wires, FIGS. 2 through 5 best reveal the preferred quantity and arrangement of these wires. It is believed advantageous to have a pair of tie wires 24 which extend longitudinally of the shaped body 16, and another pair of wires 26 which extend transversely of the shaped body. With this particular arrangement, the exposed portions of a given pair of wires may easily be wrapped around an adjacent member of the reinforcing cage, or the wires may be twisted around one another—with the cage member being captured between the wire connection and the first surface 18. To permit this optional connection of the tie wires 24,26, it is appropriate that the exposed or "free" length of a given tie wire be at least 3½ inches. With respect to the transverse tie wires 26, an initial piece of 16-gauge steel wire about 10" long is bent so as to produce a V-shape in the center of the wire, with oppositely directed and co-linear portions being arranged for producing the eventual exposed portions shown in FIGS. 3 and 4. With respect to the longitudianl wires 24, an initial piece of steel wire about 18 inches long is initially bent so as to produce a V-shaped segment having an included angle of about 120 degrees. At the distal end of the V-shaped portion are the two co-linear and oppositely directed portions which become permanently anchored to the body 16 as the body material sets or cures and becomes rigid. The exposed ends of the original 18 inch "longitudinal" tie wire will typically be slightly less than 5 inches. By providing a first surface 18 which is about 1⅜ inches wide, two parallel longitudinal wires 24 may be spaced about ¾ of an inch apart and still leave ample material on the "outside" of the body in order to resist any tendency of a tie wire to accidentally tear through the side of a body before the body material is fully cured. Expressed in other words, a ⅛ inch layer of material on the "outside" of each longitudinal wire 24 is believed to be useful in assuring the structural integrity of the shaped body 16 until it has approached its final strength. With this quantity of surrounding body material a worker need have no concern about lifting a spacer 10 by the tie wires, and even giving the spacer some relatively rough handling immediately after it is removed from a mold.

Figure 2:
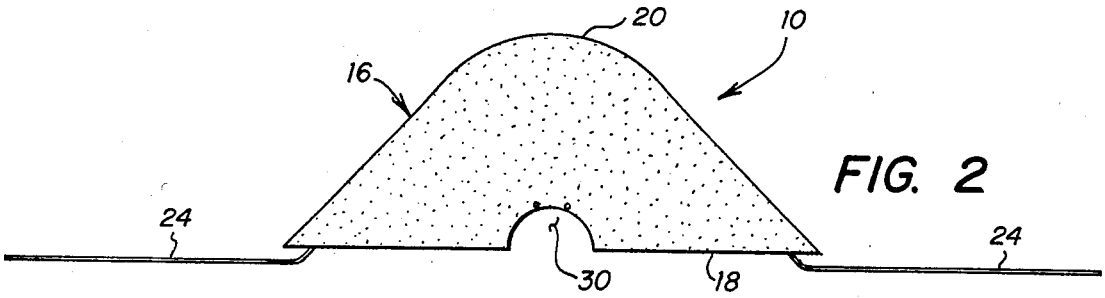
FIG. 2 is a side elevational view of a spacer, shown prior to its installation on a reinforcing cage.
Figure 3:
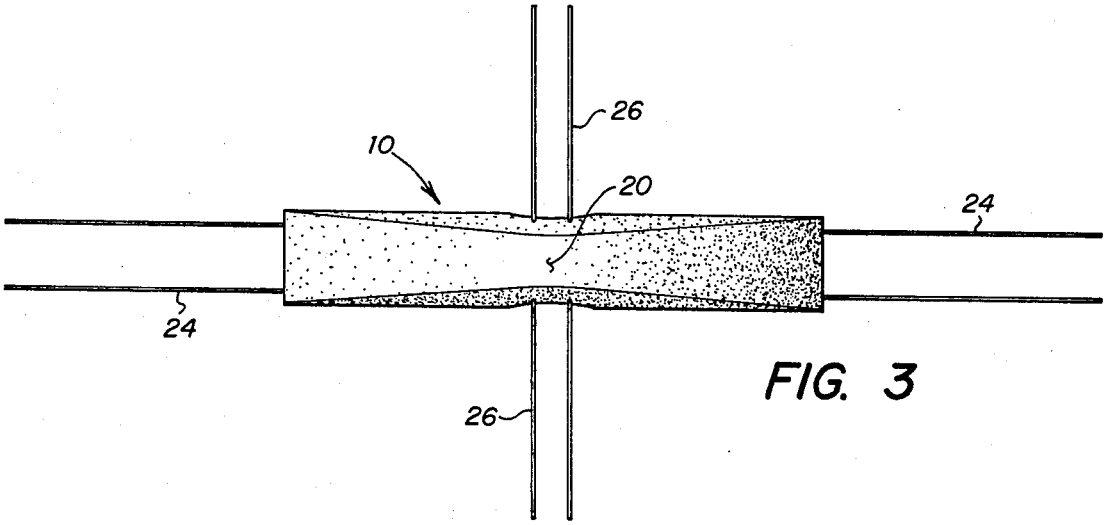
FIG. 3 is a top plan view of the spacer shown in FIG. 2 with the earth-contacting surface being arbitrarily described as the top of the spacer.
Figure 4:
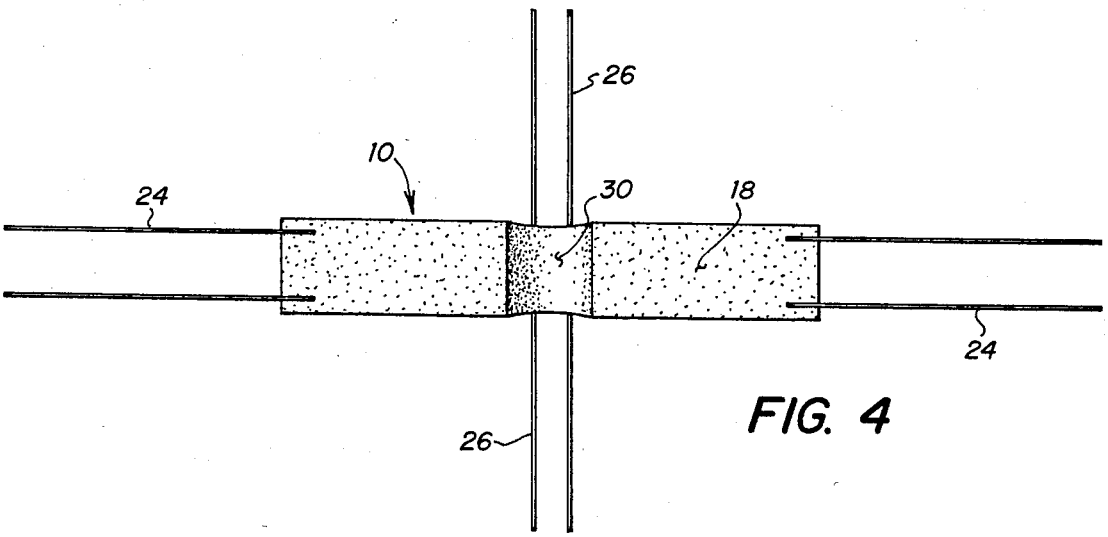
FIG. 4 is a bottom plan view of a molded spacer, and clearly showing a central recess which is adapted to be juxtaposed with a spiral member of a reinforcing cage.
Figure 5:
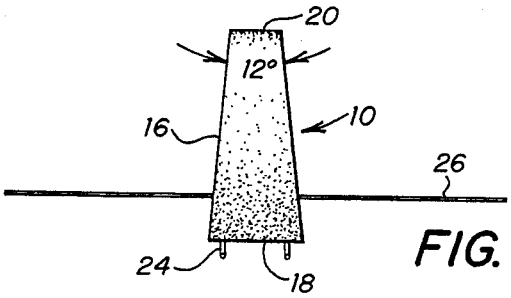
FIG. 5 is an end view of the spacer shown in FIG. 2.

Another feature of the spacer 10 is visible in FIG. 2, wherein it will be apparent that the longitudinal tie wires 24 emerge from the shaped body 16 in a direction that is away from the second surface 20. By establishing this initial direction of the tie wires 24, the step of tying a spacer 10 to a reinforcing cage requires a minimal amount of initial bending of the tie wires.

In use, plurality of spacers 10 will typically be brought to a job site and placed longitudinally along a reinforcing cage that is lying on the ground. A first spacer 10 is then positioned so that its first surface 18 is immediately next to the outer surface of one of the longitudinal members 12 of the cage. Ideally the spacer 10 is also located so that a helical cage member 14 is nested within the concave portion 30. The longitudinal tie wires 24 are then wrapped around member 12 and twisted together; and the transverse tie wires 26 are wrapped around helical member 14 and twisted together. A second spacer 10 is then positioned next to another one of the longitudinal members 12 of the reinforcing cage, and placed longitudinally with respect to the first spacer. This second spacer 10 may or may not be connected to the same helical member 14; but in any event, a plurality of spacers 10 will be positioned both longitudinally and peripherally around the reinforcing cage. After an appropriate number of spacers has been affixed to the cage, a crane is used to lift the cage so that it becomes vertical, and it is then translated so that it is positioned over the waiting pier hole. The cage is then lowered into the pier hole, with the spacers ensuring that any deviation from the center of the hole is resisted, and the confinement of a reinforcing cage near the center of a pier is assured.

Lowering a reinforcing cage into a pier hole in soft ground provides the worst possible environment for using the spacers 10, because the frangible nature of some raw earth makes the sidewalls particularly susceptible to damage from the sliding movement of steel reinforcing cage. And, if particularly troublesome regions of water, sand, etc., are encountered in drilling a pier hole, it may even be necessary to utilize a temporary sleeve or casing—which is inserted into the hole until such time as concrete can be poured therein. If the spacers 10 as described herein are effective in maintaining a reinforcing cage in the center of an earthen hole having relatively soft sides, these spacers will obviously be effective in centering a cage within a rigid casting. So, for convenience herein, the spacer 10 is simply being described as being adapted to hold a metal reinforcing cage away from the sides of a pier hole, without regard to whether that hole is lined or not.

Having described the preferred embodiment of this invention in substantial detail, it should now be apparent to those skilled in the art that incidental deviations might be permissible without reducing the benefits described herein. For example, the second surface 20 has been been illustrated as being generally flat or planar (though curved); but making it gently rounded—as seen in a transverse plane—would not likely affect the serviceability of the spacer. Therefore, the scope of the invention should be understood to be measured only by the claims attached hereto.

What is claimed is:

1. A wedge-shaped spacer adapted to hold a metal reinforcing cage away from the sides of a pier hole into which the cage is to be installed, said cage being installed prior to the step of pouring wet concrete into the hole and around the cage, comprising:

(a) wedge-shaped body of cementitious material having a first surface adapted to be positioned immediately next to an outer surface of a selected member of the reinforcing cage and the body having a second surface which is convex and which projects outwardly where it is adapted to bear against the sides of the hole, and the distance between the first and second surfaces providing a stand-off distance to hold the reinforcing cage away from the sides of the hole, and the angles of intersection between the two ends of the first surface and the convex second surface being acute angles, such that the two ends of the shaped body may be accurately described as pointed when examined in a side elevational view, and further including a concave portion in the first surface of the shaped body, and the concave portion being substantially smaller than the convex second surface, and said concave portion being located so that it may be easily juxtaposed with a spirally wrapped member of the reinforcing cage, and the sides of the shaped body being generally planar, whereby the passage of wet concrete around a vertically oriented shaped body will be facilitated; and (b) a plurality of tie wires molded integrally with the shaped body so as to be permanently connected therewith, and the wires having portions which extend outwardly from the shaped body so as to facilitate the step of tying the shaped body to a selected member of the reinforcing cage, and said plurality of tie wires including at least two wires which are oriented longitudinally of the shaped body and at least two other wires which are oriented transversely of the shaped body.

2. The spacer as claimed in claim 1 wherein the shaped body is tapered from a relatively wide first surface to a relatively narrow second surface.

3. The spacer as claimed in claim 1 wherein each of the tie wires has a free length of at least 3½ inches, and wherein the tie wires are formed of 16-gauge steel wire.

4. The spacer as claimed in claim 1 wherein the shaped body is made of material having a compressive strength of at least 6000 psi.

5. The spacer as claimed in claim 1 wherein the first surface is generally flat and has a length of at least six inches and a width of at least one inch.

6. The spacer as claimed in claim 1 wherein the first and second surfaces are separated at their respective midpoints by at least 3 inches, whereby the reinforcing cage is held away from the side walls of the hole by at least 3 inches when a plurality of spacers are distributed peripherally around the reinforcing cage.

7. The spacer as claimed in claim 1 wherein the wedge-shaped body has a transverse cross section which is tapered from its first surface which is relatively wide to its second surface which is more narrow, and the body has an included angle of about 12 degrees.

8. The spacer as claimed in claim 1 wherein each of the tie wires is bent to provide a V-shaped segment prior to being connected to the shaped body, and the V-shaped segments are buried within the shaped body after said shaped body is molded.

9. The spacer as claimed in claim 1 wherein the tie wires are arranged as four pairs of wires, with two pairs of wires being approximately perpendicular to the other two pairs.

10. The spacer as claimed in claim 1 wherein at least some of the tie wires are arranged in pairs that are generally parallel and they are spaced apart by about ¾ inch at the place where they emerge from the shaped body.

11. The spacer as claimed in claim 1 wherein the material of the shaped body is a concrete-base material having a compressive strength of at least 6000 psi, and the weight of the spacer is less than 2 pounds.

* * * * *